US007398630B2

(12) United States Patent
Kovacs

(10) Patent No.: US 7,398,630 B2
(45) Date of Patent: Jul. 15, 2008

(54) INFEED ASSEMBLY FOR A CONTINUOUS MOTION WRAPPING ASSEMBLY

(76) Inventor: Lloyd Kovacs, W1937 Edgewood Rd., Sheboygan, WI (US) 53083

( * ) Notice: Subject to any disclaimer, the term of this patent is extended or adjusted under 35 U.S.C. 154(b) by 0 days.

(21) Appl. No.: 11/507,905

(22) Filed: Aug. 22, 2006

(65) Prior Publication Data

US 2008/0047232 A1 Feb. 28, 2008

(51) Int. Cl.
*B65B 63/02* (2006.01)
*B65G 47/31* (2006.01)

(52) U.S. Cl. ..... 53/439; 53/529; 53/547; 198/461.1

(58) Field of Classification Search ..... 198/459.1, 198/460.1, 461.1, 461.2, 461.3; 53/439, 53/450, 451, 461, 493, 529, 547, 548, 558, 53/389.3, 51, 55
See application file for complete search history.

(56) References Cited

U.S. PATENT DOCUMENTS 2,296,142 A * 9/1942 Campbell ..... 53/51
3,660,961 A * 5/1972 Ganz ..... 53/448
3,664,088 A 5/1972 Sherman
3,894,627 A * 7/1975 Jabbusch et al. ..... 198/461.1
3,925,139 A 12/1975 Simmons
4,017,713 A 4/1977 Lodi
4,054,474 A * 10/1977 Collins et al. ..... 53/442
4,218,863 A * 8/1980 Howard et al. ..... 53/547
4,230,218 A * 10/1980 Kunzmann ..... 198/461.3
4,430,844 A * 2/1984 James ..... 53/547
4,514,963 A * 5/1985 Bruno ..... 198/460.1
4,525,977 A * 7/1985 Matt ..... 53/450
4,590,735 A 5/1986 Dohrendorf
4,796,499 A 1/1989 Achelpohl
4,860,621 A 8/1989 Totani
5,195,300 A * 3/1993 Kovacs et al. ..... 53/529
5,205,808 A 4/1993 Gebhardt
5,244,449 A 9/1993 Totani
5,341,915 A * 8/1994 Cordia et al. ..... 198/460.1
5,374,232 A 12/1994 Cipollone
5,410,800 A 5/1995 Gray
5,762,175 A * 6/1998 Focke et al. ..... 198/461.2
6,003,288 A 12/1999 Sperry et al.
6,254,521 B1 7/2001 Pansier et al.
6,648,125 B1 * 11/2003 Bershadsky ..... 198/461.1
6,898,922 B2 5/2005 Reist
7,104,031 B2 * 9/2006 Baggot et al. ..... 53/439

* cited by examiner

*Primary Examiner*—Louis Huynh
(74) *Attorney, Agent, or Firm*—Boyle Fredrickson S.C.

(57) ABSTRACT

An infeed assembly for spacing a continuous line of product into units to be wrapped in a continuous wrapping system is disclosed. At least one set of registration belts is orientated downstream of a set of spaced infeed belts in communication with a continuous line of product. The registration belts are programmed to move at the same velocity as the infeed belts to receive a product and then at a velocity greater than the infeed belt in order to separate and register one or more products into units to be wrapped and before returning to the velocity of the infeed belts.

15 Claims, 9 Drawing Sheets

INFEED ASSEMBLY FOR A CONTINUOUS MOTION WRAPPING ASSEMBLY

BACKGROUND OF THE INVENTION

1. Field of the Invention

The present invention relates to a method and apparatus for wrapping products such as napkins, rolls of toilet paper and paper towels. More particularly, the present invention relates to a method and apparatus for the continuous wrapping of products, wherein a continuously fed wrapping material is formed into a tube, articles are fed into the tube, and the tube is separated between the sequential units of products at spaced intervals by a heated cutting element moving along the path of the tube.

2. Discussion of the Related Art

A wide variety of consumer products are mass production wrapped in a heat sealable wrapping material before being delivered to the customer. For example, numerous paper products such as napkins, paper toweling rolls, or toilet paper rolls are wrapped in a thermoplastic material such as polyethylene. The thermoplastic wrapper serves to hold the articles tightly together and to protect them from moisture and abrasion.

As is often the case for products prepared for the consumer mass market, the cost per unit article is strongly dependent on the amount of time required for each operation, including packaging. Known prior art wrapping machines require the product to be displaced from its direction of motion several times during the packaging operation to produce a sealed overwrap of heat sealable material around the product and then to fold and heat seal the ends of the packaging about the product. The displacements and reciprocations of the product within the machine limits the production speed because of the time that must be allocated to such motions. Additionally, the motions of the machine parts required to change the direction of motion of the articles invariably leads to shock and vibration which can become severe as machine speed is increased. In addition, the mechanism for separating the heat sealable material is also crucial to the performance and efficiency of the machine. In many prior art devices, the speed of the wrapping machine is often limited by reason of having to cut a tube transversely as it is continuously fed forward. The cutting step makes it difficult or impossible to achieve a fully compressed or tightly wrapped product.

The below-referenced U.S. patents disclose embodiments that were at least, in part, satisfactory for the purposes for which they were intended. The disclosures of all the below-referenced prior United States patents in their entireties are hereby expressly incorporated by reference into the present application for purposes including, but not limited to, indicating the background of the present invention and illustrating the state of the art.

U.S. Pat. Nos. 2,545,243; 2,982,334; 3,011,934; 3,050,916; 3,133,390; 3,153,607; 3,325,331; 3,576,694; 4,054,474; and 4,084,999 disclose various methods for the formation of a heat sealed wrapper about an article. Many of these references, while somewhat satisfactory for their intended purpose, operate on reciprocating motion and include numerous moving parts in, e.g., their flighted infeed systems. The flighted infeed systems disclosed are often slave driven by the upstream folder machines and as a result, flight jams are commonly caused by timing issues.

U.S. Pat. No. 4,430,844 to James discloses a machine capable of forming sealed wrappers around articles. The machine disclosed in the James patent achieves separation of articles by introducing transverse lines of weaknesses into a flat film at measured intervals representing the wrapper length. The film is then formed into a tube and articles to be wrapped are introduced into the continuously moving tube. Separation into individual packages is achieved as leading wrapped package is pulled forward at a higher speed thereby severing it from a tube at the line of weakness. Although this method works for film or paper wrapping material, special care must be taken to ensure good film tension control as well as perforation geometry in order to avoid premature separation. The machine is also extremely sensitive to variations in film properties and does not allow for product compression.

U.S. Pat. No. 4,218,863 to Howard et al. also discloses a method and apparatus for forming sealed wrappers around articles. The machine disclosed in the Howard patent achieves separation of articles by cutting of the tubular film with a rotating serrated knife. The disclosed method works for film, but it is generally limited to single roll products.

In view of the above, it will be apparent to those skilled in the art from this disclosure that there exists a need for an improved system, apparatus and method for wrapping articles. It is preferred to have a wrapping machine that can receive articles to be wrapped and form an overwrap on the articles in substantially continuous motion through the machine. It is further desirable for a continuous motion wrapping assembly that allows much higher production speeds to be obtained. There is a further need for improvements to the infeed systems and cutting systems of known continuous motion wrapping assemblies. This invention addresses this need in the art as well as other needs, which will become apparent to those skilled in the art from this disclosure.

SUMMARY AND OBJECTS OF THE INVENTION

In accordance with aspects of the present invention an improved system, method and apparatus are provided for wrapping articles such as stacks of napkins, or rolls of paper, (e.g. toilet tissue or paper toweling), at relatively high speed and enabling use of various wrapping materials. In another aspect of the invention, a method and apparatus that allows for continuous wrapping of articles wherein speed is not limited by reason of having to cut or perforate the tube transversely as it is continuously fed forward is provided. In still another aspect of the invention, a method and apparatus which effects separation by thermal cutting with a heated element that moves with the moving product is provided. In another aspect of the invention, an infeed system for a wrapping assembly that eliminates the use of flight bars and the problems associated with flighted infeed systems is provided. In a further aspect of the invention, an alternative to infeed systems that are slave driven by upstream folder machines is provided. In another aspect of the invention, an infeed system that allows for the compression of the products as they move through the infeed system such that the product is unaffected by its movement at a high speed is provided.

Consistent with the foregoing, and in accordance with the invention as embodied and broadly described herein, an infeed assembly for a continuous wrapping system, a method of spacing a continuous line of product into units to be wrapped and a continuous wrapping system are disclosed in suitable detail to enable one of ordinary skill in the art to make and use the invention. In accordance with a first aspect of the invention, the above and other objects are achieved by providing an infeed assembly for a continuous wrapping system that includes at least one infeed belt in communication with a continuous line of product and at least one registration belt downstream of the infeed belt. The registration belt moves at least one product temporarily at a velocity greater than the infeed belt thereby spacing one or more products into units to be wrapped.

In one example, the at least one registration belt comprises a single registration belt for separating product into a unit to be wrapped. Alternatively, the at least one registration belt may include two or more registration belts for separating multiple products into a unit to be wrapped. The infeed belt may include vertically spaced upper and lower compression belts for compressing the product into a desired girth for wrapping. The distance between the upper and lower compression belts may be adjustable.

In another example, the at least one registration belt includes a pair of spaced registration compression belts orientated such that the space between the pair of registration belts is equal to the space between the upper and lower infeed compression belts.

In still another example, the at least one registration belt moves at a velocity equal to the movement of the infeed belt to receive a product, then moves at a velocity greater than the infeed belt once the product is on the at least one registration belt and then returns to a velocity equal to the movement of the infeed belt once the product is no longer on the registration belt. The product may be a stack of napkins or a roll of paper.

In yet another embodiment, a method of spacing a continuous line of product into units to be wrapped includes the steps of diverting the continuous line of product onto a first set of moving belts, positioning a second set of moving belts downstream of the first set of belts and setting the second set of moving belts to operate at least temporarily at a velocity greater than the first set of belts. In one example, the first and second set of belts are compression belts.

The method may also include the step of moving the product from the second set of belts onto a third set of belts configured to insert the spaced units into a continuously moving tube of thermoplastic material. In one example, the continuously moving tube of thermoplastic material is cut with a heated element.

In still another embodiment, a continuous wrapping system includes an infeed system including at least one set of spaced infeed compression belts in communication with a continuous line of product and at least one set of registration belts downstream of the infeed belts. The registration belts are programmed to move at the same speed as the infeed belts to receive a product and at a velocity greater than the infeed belts in order to separate and register one or more products into units to be wrapped. A tube wrapper forming section downstream of the infeed system is configured to form a continuously moving tube of thermoplastic material around the units to be wrapped and a cutting system is configured to separate the units from the continuously moving tube of thermoplastic material into individually wrapped units.

In one example, the registration belts move temporarily at a velocity equal to a downstream forming shoulder infeed belts of the tube wrapper forming section. In a final example, a heated cutting element that moves in both the transverse and horizontal directions is configured to separate the tubular thermoplastic material. At least a portion of the horizontal movement of the heated cutting element occurs at the same speed and in the same direction as the movement of the tubular thermoplastic wrapping material.

These, and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
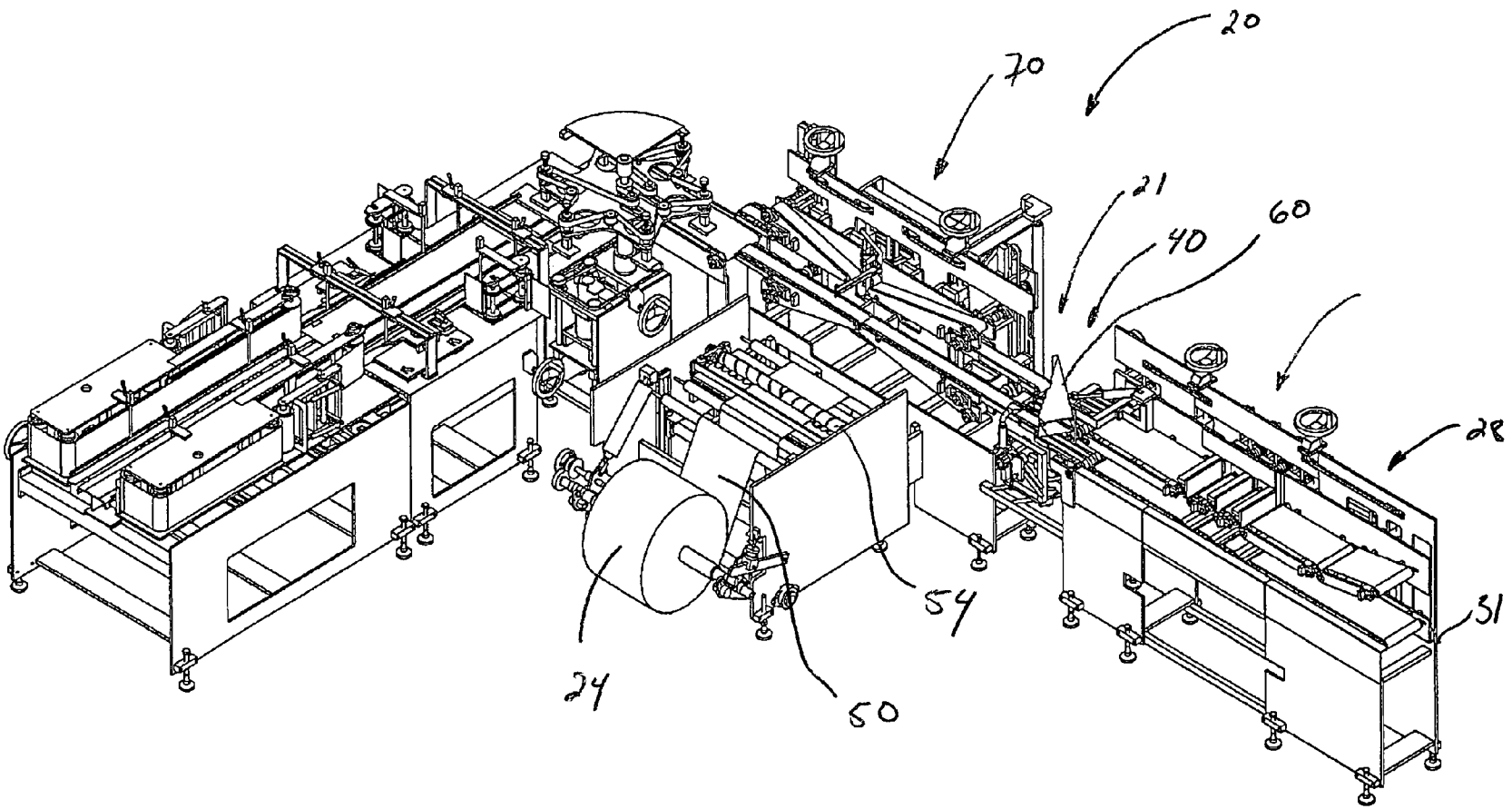
FIG. 1 is a perspective view of a continuous motion wrapping system or machine constructed in accordance with a preferred embodiment of the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

DESCRIPTION OF PREFERRED EMBODIMENTS

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Referring to the drawings, wherein like numerals refer to like parts in each view, an overall perspective view of a continuous motion wrapping assembly or system 20, including a wrapping apparatus or wrapping machine 21 is shown in FIG. 1. The operation of the wrapping system 20 will be described with regard to the packaging of articles or products 22, such as napkins, in wraps of polyethylene or other thermoplastic material. However, it is understood that a wide variety of other products having different shapes and sizes may be wrapped with other types of heat sealable or thermoplastic packaging material. Such alternative products 22 include, but are in no way limited to roll products such as paper towels or toilet paper.

As noted above, the illustrated embodiment is directed at wrapping product 22 into compressed packaged units 25. It is contemplated that the invention may be used to wrap units 25 of product 22 comprising, e.g., single stacks or rolls, as well as units 25 of product 22 comprising, e.g., multiple stacks or rolls. As discussed in greater detail below, the units 25 are compressed and encased in a web of continuously moving thermoplastic wrapping material (e.g. polyethylene film) fed forward from a supply roll 24 and formed into a tube 91 around the units 25. At predetermined intervals, the units 25 are fed into the tube 91 one after another and spaced lengthwise in the tube 91 at wrapper length intervals. The tube 91 of wrapping material is then cut at a position between units 25 corresponding to wrapper intervals by a moveable heated cutting element 26 such as a heated knife or wire to form individually girth wrapped units.

Figure 2:
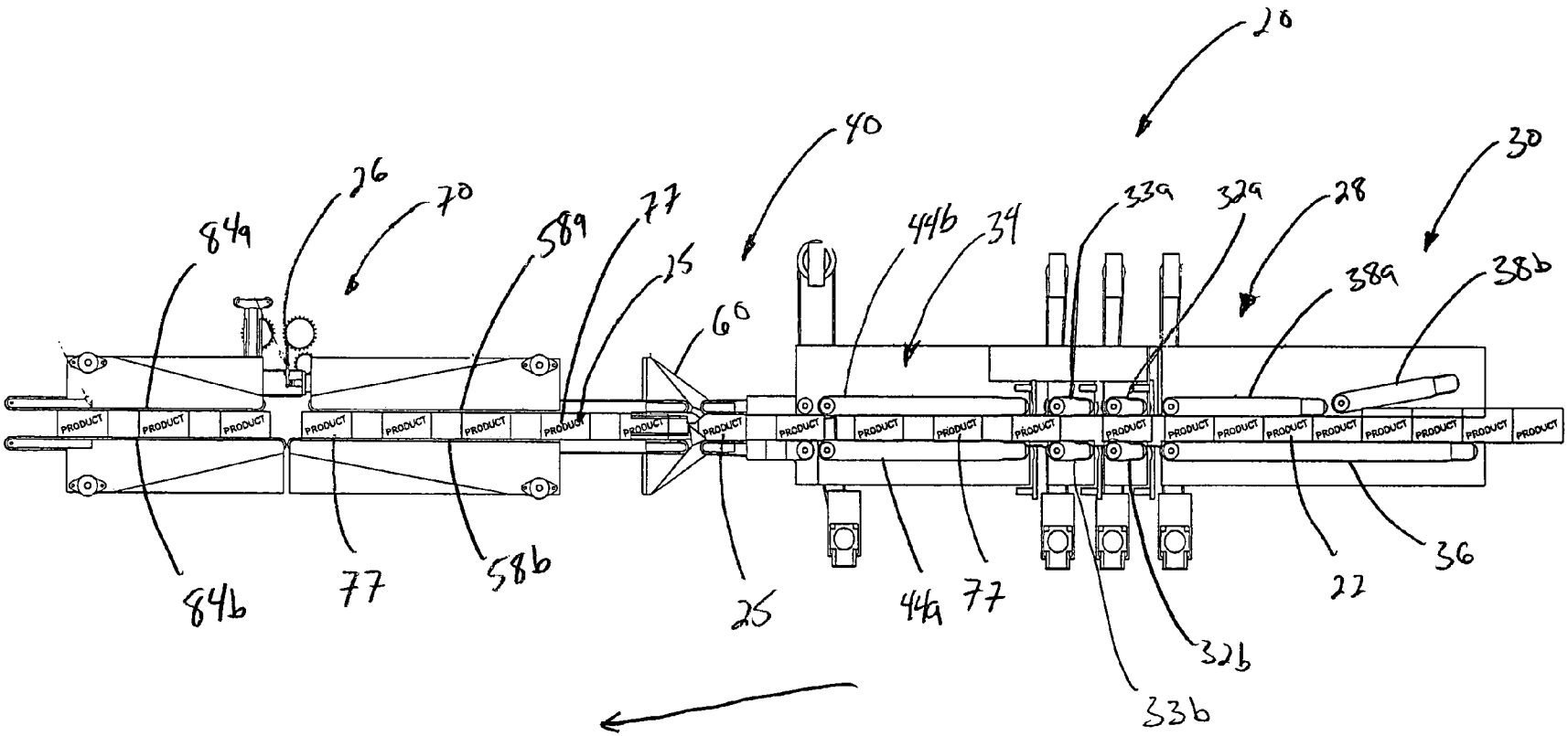
FIG. 2 is a side view of the infeed assembly and cutting assembly of the system of FIG. 1 shown separating a backlog of a continuous line of products into equally spaced wrapped single product units.
Figure 3:
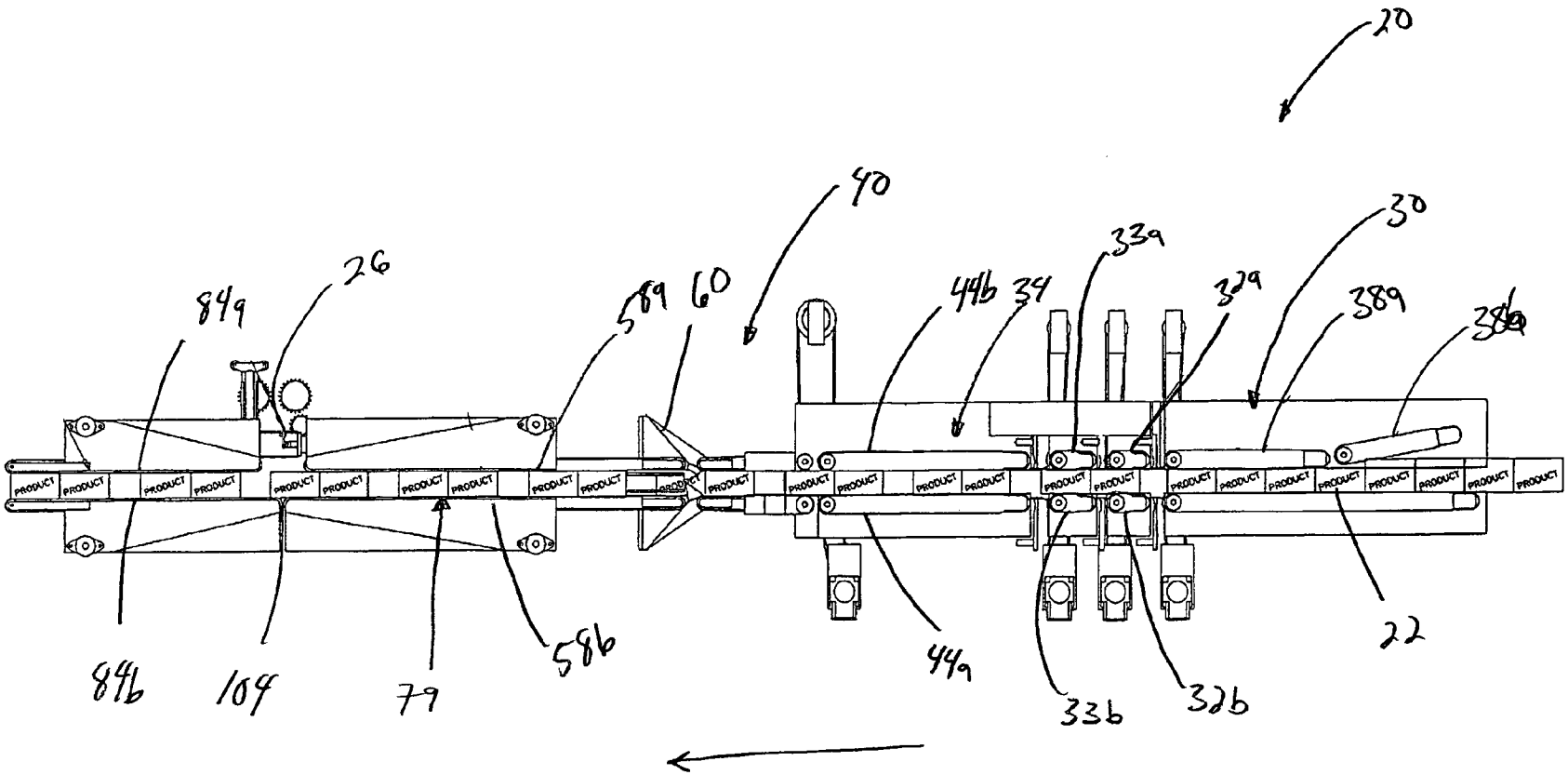
FIG. 3 is a side view of the infeed assembly and cutting assembly of the system of FIG. 1 shown separating a backlog of a continuous line of product into equally spaced wrapped two product units.

Referring to FIGS. 1-3, unwrapped, uncompressed product 22 (e.g., napkin stacks or paper rolls) are delivered to the continuous motion wrapping system 20 on a standard conveyor belt assembly (not shown) or by hand. In one preferred embodiment, the wrapping system 20 could include a zero back pressure conveyor to accumulate and arrange the product 22 into stacks, such as napkin stacks, in a continuous line.

The sequential product 22 received from the conveyor is then delivered to the infeed system or assembly 28. As illustrated in FIGS. 1-3, the infeed assembly 28 of the wrapping system 20 arranges the uncompressed product 22 to be wrapped in longitudinal alignment and selectively spaces the product 22 into units 25. The spacing of the units 25 preferably corresponds to the preferred wrapper length size. The preferred infeed assembly 28 includes adjustable servomotor driven infeed compression belts 30, single pack registration belts 32, twin pack registration belts 33 and forming shoulder infeed belts 34. It is understood that a wide variety of alternative programmable prime movers could be used to drive the belts of the infeed assembly in addition to the disclosed servomotors. Such alternative prime movers include, but are not limited to, stepper motors and vector motors.

Preferably, the infeed compression belts 30 include a lower belt 36 and first 38*a* and second 38*b* upper belts driven by an electric servomotor connected to the frame 31. It is also contemplated that a single upper belt could be utilized. As illustrated in FIGS. 1 and 2, the lower 36 and upper 38*a*, 38*b* belts receive the continuously fed product 22 from a conveyor or other means. The product 22 is compressed between lower 36 and upper 38*a*, 38*b* belts to a preferred girth for packaging. It is understood that the space between lower 36 and upper 38*a*, 38*b* belts may be manually or automatically adjusted to account for alternative packaging needs.

Once the product 22 has moved through the infeed compression belts 30, it is continuously moved through individually servomotor (or other prime mover) driven single registration belts 32*a*, 32*b* and twin pack registration belts 33*a*, 33*b* of the infeed system 28. The single registration belts 32*a*, 32*b* and the twin pack registration belts 33*a*, 33*b* space and register the product 22 into preferred units 25. (It is understood that while the described infeed assembly 28 is preferred, prior art spacing means such as spacing bars attached to the belts, could also be used with the inventive cutting system described below.) The single registration belts 32*a*, 32*b* and the twin pack registration belts 33*a*, 33*b* are preferably programmed or alternatively configured to move product 22 at multiple varying velocities in their continuous horizontal movement, thereby spacing and registering the product into units 25 for wrapping. In addition, the single registration belts 32*a*, 32*b* and the twin pack registration belts 33*a*, 33*b* are also compression belts, thereby serving to maintain the product 25 in a preferred girth for packaging and prevent loose product 22, such as napkins, from separating from a stack. It should be understood that the velocities of the single registration belts 32*a*, 32*b* and the twin pack registration belts 33*a*, 33*b* are selectively adjustable in relation to the velocity of the infeed compression belts 30 and forming shoulder infeed belts 34 to provide for alternative preferred spacing among single stack product units 77 (FIG. 2) or multiple, such as double stack product units 79 (FIG. 3). As described below, when only single stack product units 77 are preferred the twin pack registration belts 33*a*, 33*b* move at constant velocity in sync with the movement of the downstream forming shoulder infeed belts 34.

Figure 8A:
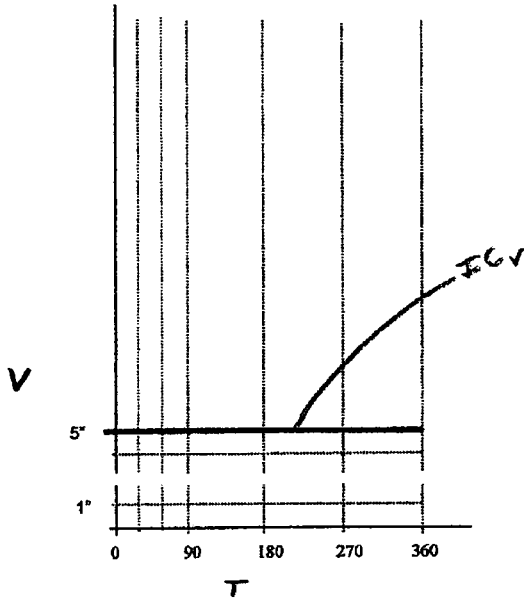
FIGS. 8A-8D are velocity profiles for the components of the infeed assembly of the system of FIG. 1 during the spacing and registration of a single stack product unit.
Figure 8B:
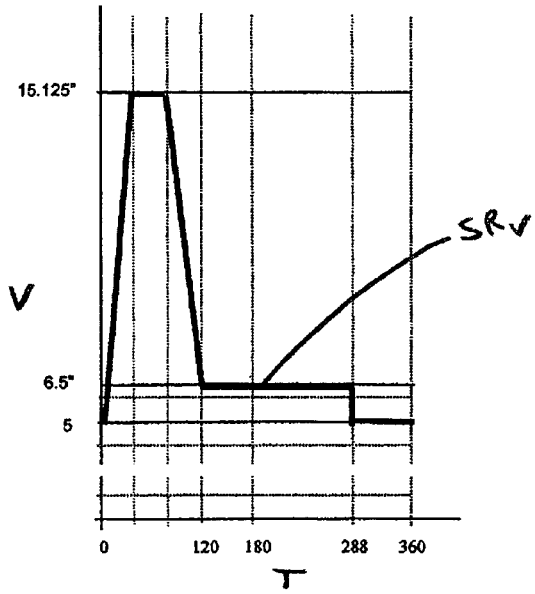
Figure 8C:
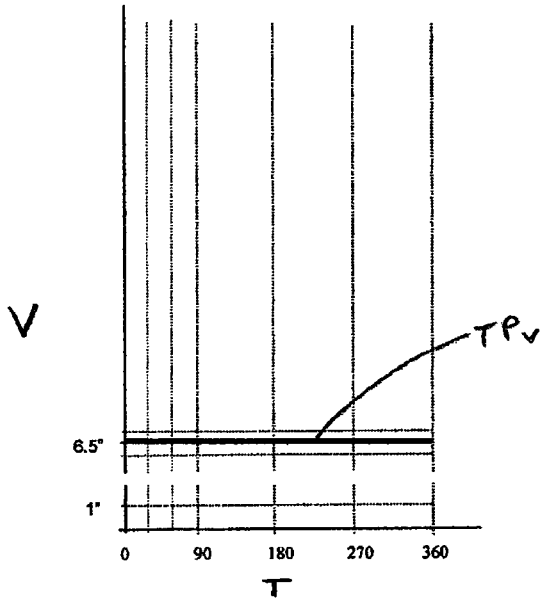
Figure 8D:
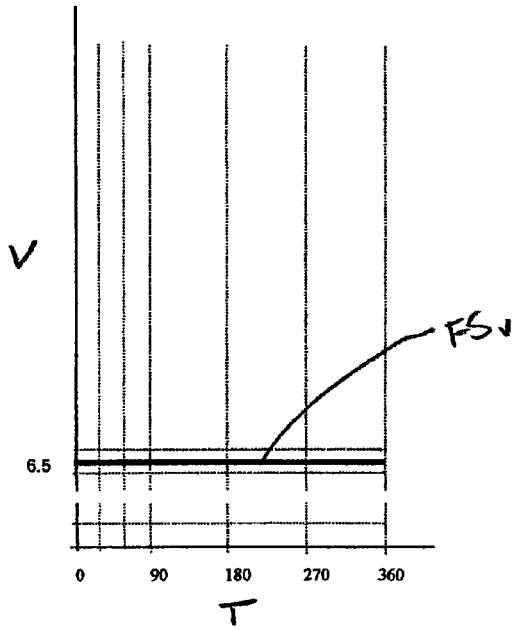

FIGS. 8A-8D are graphs illustrating the velocity profiles of the infeed compression belts 30, single registration belts 32*a*, 32*b*, twin pack registration belts 33*a*, 33*b* and forming shoulder infeed belts 34 during the spacing and registration of a single stack product unit 77. As illustrated by FIG. 8A the infeed compression belts 30 move at a constant velocity $IC_v$ throughout the wrapping process. FIGS. 8C and 8D illustrate the velocity of the twin pack registration belts $TP_v$ and the forming shoulder infeed belts $FS_v$ respectively. As illustrated, the twin pack registration belts 33*a*, 33*b* and the forming shoulder infeed belts 34 are also moving at a constant velocity throughout the wrapping process of a single stack product unit 77.

Turning to FIG. 8B the velocity of the spaced single registration belts $SR_v$ is illustrated through a full 360 degree cycle of operation. As shown at 0 degrees in FIG. 8B, the single registration belts 32*a*, 32*b* initially move at a velocity equal to the velocity of the upstream infeed compression belts 30. Once a single stack product unit 77 is entirely between the single registration belts 32*a*, 32*b* and no longer in contact with the infeed compression belts 30, the velocity of the single registration belts 32*a*, 32*b* increases to a velocity greater than the velocity of the infeed compression belts 30 and the forming shoulder infeed belt, thereby separating the unit from the continuous line of product 22. Once separated to the preferred spacing, as the single stack product unit 77 remains between the single registration belts 32*a*, 32*b*, the velocity of the single registration belts 32*a*, 32*b* decreases to a velocity equal to the continuous velocity of the downstream twin pack registration belts 33*a*, 33*b* and forming shoulder infeed belts 34 at 120 degrees, thereby registering the product. As noted above, when a single stack/product unit 77 is desired, the velocities of the twin pack registration belts 33*a*, 33*b* and forming shoulder infeed belts 34 are preferably equal.

As the single stack product unit moves off the single registration belts 32*a*, 32*b* onto the twin pack registration belts 33*a*, 33*b* at about 288 degrees, the single registration belts 32*a*, 32*b* return to moving at a velocity equal to the infeed compression belts 30. Thus, the movement of single stack/product units 77 across the single registration belts 32*a*, 32*b* will include at least movement at a velocity equal to the upstream infeed compression belts 30, movement at a velocity greater than the infeed compression belts 30 and the forming shoulder infeed belts 34, and movement at a velocity equal to the downstream forming shoulder infeed belts 34. As noted, once the individual single stack/product unit 77 completes the movement through the single registration belts 32*a*, 32*b*, the single registration belts 32*a*, 32*b* are again moving at a velocity equal to the velocity of the infeed compression belts 30 and the single registration belts 32*a*, 32*b* are ready to receive the next product from the continuous line of product 22 at 360 degrees. It should be noted that a wide variety of alternative velocities could be set depending on the packaging needs.

Figure 9A:
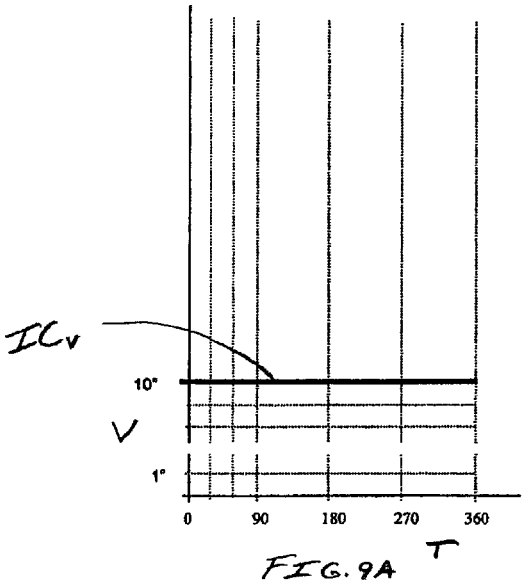
FIGS. 9A-9D are velocity profiles for the components of the infeed assembly of the system of FIG. 1 during the spacing and registration of a double stack product unit.
Figure 9B:
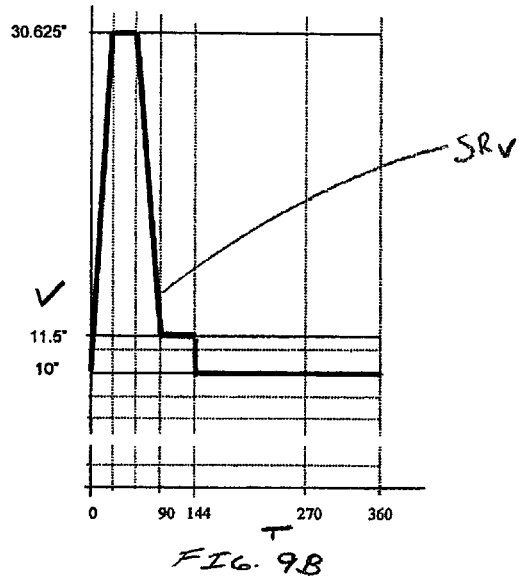
Figure 9C:
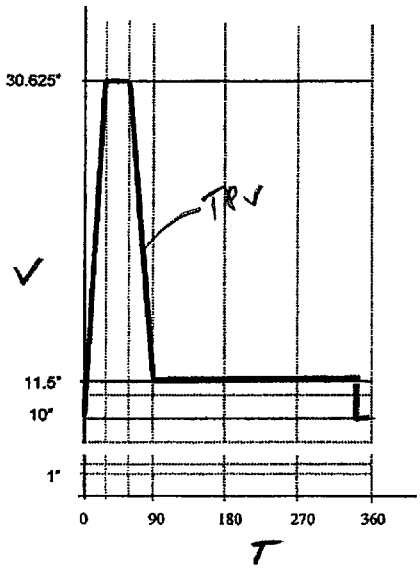
Figure 9D:
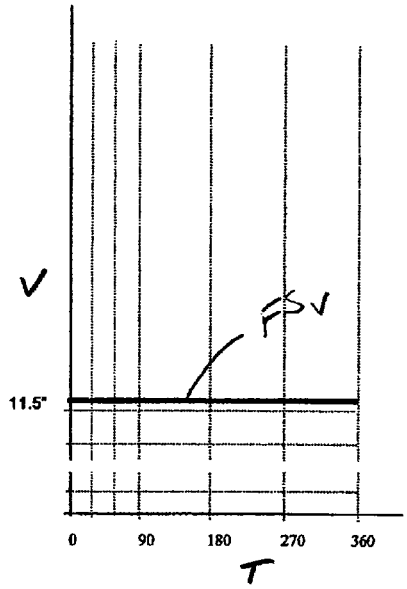

FIGS. 9A-9D are graphs illustrating the velocity profiles of the infeed compression belts 30, single registration belts 32*a*, 32*b*, twin pack registration belts 33*a*, 33*b* and the forming shoulder infeed belts 34 during the registration of multiple product units, such as double stack product units 79. As illustrated by FIG. 9A, the infeed compression belts 30 again move at a constant velocity $IC_v$ throughout the wrapping process. FIGS. 9B and 9C illustrate the velocity of the spaced single registration belts $SR_v$ and twin pack registration belts $TP_v$ respectively. FIG. 9D illustrates the velocity of forming shoulder infeed belts $FS_v$ which is also moving at a constant velocity.

As shown in FIGS. 9A and 9B, when double stack product units 79 are preferred, the spaced single registration belts 32*a*, 32*b* and the twin pack registration belts 33*a*, 33*b* move at synchronized velocities during a portion of their movement. Initially, the single registration belts 32*a*, 32*b* and the twin pack registration belts 33*a*, 33*b* move at a velocity equal to the velocity of the upstream infeed compression belts 30. Once two adjacent stacks of product 22 are entirely between the single registration belts 32*a*, 32*b* and the twin pack registration belts 33*a*, 33*b* and no longer in contact with the infeed compression belts 30, the velocity of the single registration belts 32*a*, 32*b* and the twin pack registration belts 33*a*, 33*b* increases to a velocity greater than the velocity of the infeed compression belts 30 thereby separating a double stack product unit 79 from the continuous line of product 22. Once separated to the preferred spacing, as the double stack product unit 79 remains between the single registration belts 32*a*, 32*b*, and the twin pack registration belts 33*a*, 33*b*, the velocity of the single registration belts 32*a*, 32*b* and the and the twin pack registration belts 33*a*, 33*b* decreases to a velocity equal to the continuous velocity of the forming shoulder infeed belts 34 thereby registering the product. As the double stack product unit 79 moves off the single registration belts 32*a*, 32*b*, the single registration belts 32*a*, 32*b* decreases its velocity to a velocity equal to the velocity of the infeed compression belts 30. Moments later as the double stack product unit 79 moves off the twin pack registration belts 33*a*, 33*b*, the twin pack registration belts 33*a*, 33*b* decreases its velocity to a velocity equal to the velocity of the infeed compression belts 30. The single registration belts 32*a*, 32*b* and the twin pack registration belts 33*a*, 33*b* are then ready to receive the next product from the continuous line of product 22.

As described above, the servomotor or other prime mover driven infeed system 28 allows a user to backlog a continuous line of product 22 and separate the product 22 into spaced units 25. Due to the orientation of the single registration belts 32*a*, 32*b* and twin pack registration belts 33*a*, 33*b* the product 22 may be formed into single stack product units 77 or multiple, such as double stack product units 79. In addition, the product 22 remains compressed without damage to the product from backpressure push. As a result, the in-feed system 28 eliminates the problems associated with prior art flighted infeed systems. It should be understood that in addition to the single 32 and twin pack 33 registration belts, the infeed assembly could include other belts capable of forming, for example three, four or more aligned stacks of product 22.

Upon exiting the single registration belts 32*a*, 32*b* or the twin pack registration belts 33*a*, 33*b* of the infeed assembly 28, single stack product units 77 or double stack product units 79 (FIG. 3) are driven forward along forming shoulder infeed belts 44*a*, 44*b* one after another into a tube wrapper forming section 40 of the wrapping assembly 20. The units 77 or 69 are spaced at intervals corresponding to a wrapper length interval and inserted into a tube 91.

A variety of known tube forming mechanisms could be utilized and incorporated into the inventive wrapping system 20. In the preferred embodiment, a web 50 of thermoplastic material is positively continuously pulled from the supply roll 24 and fed forward in a horizontal path towards the tube wrapper forming section 40 of the wrapping assembly 20. The web is preferably driven by a prime mover such as a servomotor at the same velocity as the forming shoulder product-pull belts 58*a*, 58*b* which are downstream in the horizontal path of the forming shoulder infeed belts 44*a*, 44*b*. The web then travels forward from the rolls 52, 54 until it is redirected by a turning bar (not shown). The web then travels rearward relative to a tube feed means (not shown), and is trained under and up around a guide roll to the tube forming shoulder 60. The tube forming shoulder 60 is generally known in the art, with minor modifications for purposes of this invention. The forming shoulder is arranged such that as the web 50 travels up and around the shoulder 60, it is formed into a tube and, as it proceeds through a tubular guide, it becomes wrapped around the single stack product units 77 or double stack product units 79 as is known in the art. The single stack product units 77 or double stack product units 79 are also pulled forward and delivered into the tube 91 by forming shoulder product pull belts 58*a*, 58*b*. The product pull belts 58*a*, 58*b* are also driven by a servomotor or other prime mover at an adjustable speed corresponding to the movement of a heated cutting element 26 as discussed below.

The forming shoulder product pull belts 58*a*, 58*b* and the web feed rolls 52 feed the web 50 forward from the supply roll 24 to the forming shoulder 60 where the web 50 is formed into the tube 91 at a predetermined speed. For example, in the case of a single stack product units 77 with dimensions of 5" wide by 5" long by 2" high the speed may be 80 feet per minute (corresponding to a rate of 120 units per minute). As illustrated, the forming shoulder product pull belts 58*a*, 58*b* feed the tube with the product therein forward at a predetermined velocity. A drive device, preferably a servomotor, is provided for continuously driving these forward. The single stack product units 77 or double stack product units 79 inside the tube act as a back-up for the forming shoulder product pull belts 58*a*, 58*b*. The forming shoulder product pull belts 58*a*, 58*b* are preferably vacuum belts, having vacuum holes, and vacuum boxes being provided on the inside of their forward traveling reaches, for effecting vacuum gripping of the tube by the forming shoulder product pull belts 58*a*, 58*b* via the holes. Alternatively, each of the forming shoulder product pull belts 58*a*, 58*b* may be composed of a flexible material having relatively good surface friction with respect to polyethylene and other thermoplastic materials, such as a fabric backed rubber belt or certain flexible plastic belts. The upper belt 58*a*, like the other belts in the system may be adjustable toward and away from the lower belt 58*b*. Preferably the forming shoulder 60 is removable and replaceable with forming shoulders of different sizes and shapes for accommodating different products 22.

Once the spaced single stack product units 77 or double stack product units 79 have moved through the forming shoulder, the formed tube with the single stack product units 77 or double stack product units 79 is driven along the forming shoulder product pull belts 58*a*, 58*b* to the cutting assembly 70 of the wrapping system 20. The contact between the belts 58*a*, 58*b* and the tube 91 formed around the single stack product units 77 or double stack product units 79 maintains the tube 91 relatively taut and closely drawn around the product 22 within. Friction belts (not shown) may apply longitudinal tension about the periphery of the tube 91 to pull the material tight against the product 22 within.

Figure 4:
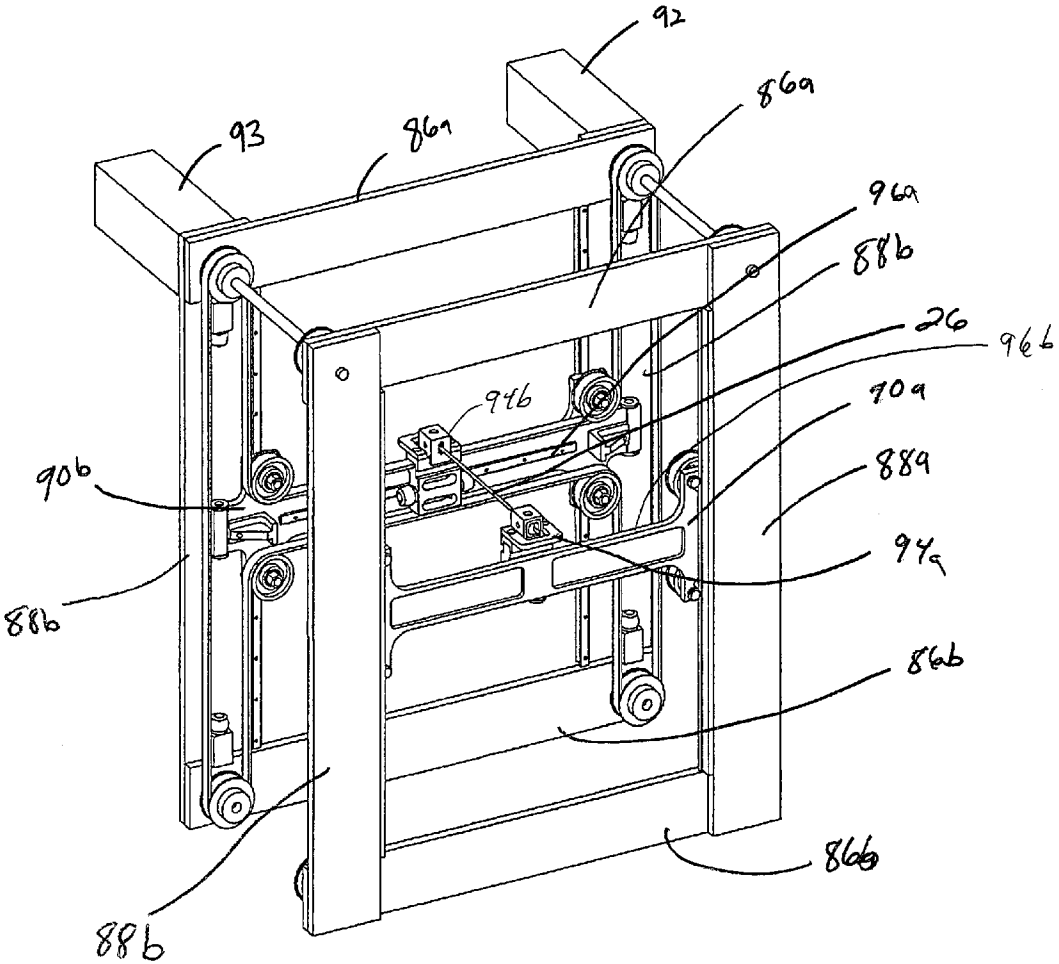
FIG. 4 is perspective view of a first embodiment of the cutting assembly of the of the system of FIG. 1.
Figure 5:
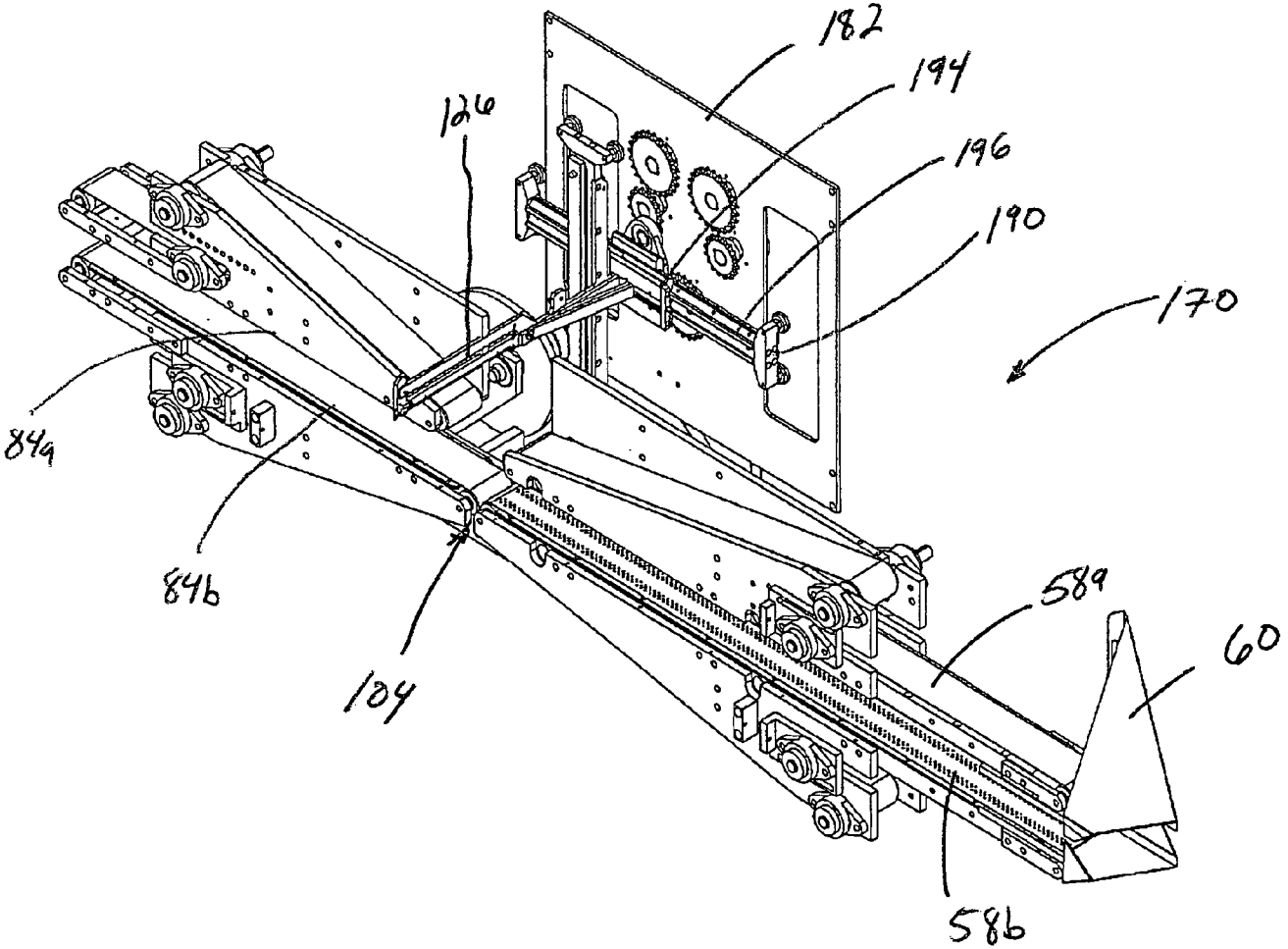
FIG. 5 is a perspective view of an alternative embodiment of the cutting assembly of the of the system of FIG. 1.

FIGS. 4 and 5 better illustrate two alternative arrangements of the cutting assembly 70 of the wrapping system 20. Both embodiments use a heated cutting element 26, such as a hot wire or knife, to cut the tube 91 of plastic surrounding the single stack product units 77 or double stack product units 79 into individually wrapped units 25. Both of the cutting assemblies illustrated in FIGS. 4 and 5 enable the heated cutting element 26 to move in a cutting cycle that includes motion in two coordinates or directions. As described in greater detail below, the cutting cycle of the heated cutting element 26 includes both horizontal (corresponding to the direction of the movement wrapping system) and transverse or vertical motion. As discussed below, at least a portion of the horizontal motion of the heated cutting element 26 matches the velocity of the continuously moving tube 91 with enclosed product 22 during a cutting function. A sufficient transverse or vertical velocity is generated to penetrate or cut a cross section of tube 91 during the cutting cycle. This transverse cutting motion is typically at a velocity greater than the horizontal motion. During the vertical motion, the heated cutting element 26 melts the tube 91, resulting in film separation (without sealing) perpendicular to direction of horizontal tube 91 movement while maintaining the tube 91 around the units 25.

Turning to FIG. 4, a first embodiment of a cutting assembly or system 70 of the packaging assembly 20 is illustrated. As illustrated in FIG. 4, a heated cutting element 26 is moveably mounted on a rectangular support 82 standing around the forming shoulder pull belts 58*a*, 58*b* and an upper 84*a* and lower 84*b* knife belt exits (FIG. 3). The heated cutting element 26 may be a heated wire, knife or other known tool that is electrically heated above the melting point of the thermoplastic material used to form the tube 91.

Support 82 includes a pair of upper 86*a* and lower 86*b* horizontal beams extending between a pair of vertical beams 88*a* and 88*b*. A pair of horizontal carriage arms 90*a*, 90*b* are respectively moveably mounted on the pairs of vertical beams 88*a*, 88*b*. The carriage arms 90*a*, 90*b* are configured to move vertically in a synchronized fashion along vertical beams 88*a*, 88*b*. The carriage arms 90*a*, 90*b* are preferably driven by belts driven by servomotors 92, 93 or other prime movers mounted to the support 82. As illustrated in FIG. 4, a pair of servomotor driven heated cutting element carriages 94*a*, 94*b* are moveably attached to tracks 96*a*, 96*b* for synchronized horizontal movement of the heated cutting element 26 on the carriage arms 90*a*, 90*b*. The heated cutting element 26 extends between the heated cutting element carriages 94*a*, 94*b*. Thus, the servos 92, 93 can be programmed to provide movement of the heated cutting element 26 in two coordinates. The synchronized horizontal carriage arms 90*a*, 90*b* move the heated cutting element 26 in a transverse or vertical direction in relation to the direction of movement of the shoulder pull belts 58*a*, 58*b* and upper 84*a* and lower 84*b* knife belt exits (FIG. 3). The synchronized heated cutting element carriages 94*a*, 94*b* provide for horizontal movement of the heated cutting element 26 in relation to shoulder pull belts 58*a*, 58*b* and an upper 84*a* and lower 84*b* knife belt exits.

FIG. 5 illustrates an alternative embodiment of a cutting system 170 of the wrapping system 20. As illustrated in FIG. 5, a cantilevered heated cutting element 126 is moveably mounted on a support 182 adjacent the forming shoulder pull belts 58*a*, 58*b* and upper 84*a* and lower 84*b* knife belt exits. A horizontal carriage arm 190 is moveably mounted to a vertical support arm 192 and support 182 for vertical movement. The horizontal carriage arm 190 is configured to move vertically along vertical support arm 192 and support 182. The horizontal carriage arm 190 is moved by belts driven by servomotors (not shown) mounted to the support 182. The heated cutting element 126 extends from a support 182 attached to a heated element carriage 194. The servo driven heated element carriage 194 is moveably attached to a track 196 on the horizontal carriage arm 190 for horizontal movement of the heated element 180 on the horizontal carriage arm 190. As a result, the servo motors can be programmed to provide movement of the heated cutting element 126 in two coordinates. For vertical movement, the horizontal carriage arm 190 moves the heated cutting element 126 in a transverse or vertical direction in relation to the direction of movement of the shoulder pull belts 58*a*, 58*b* and an upper 84*a* and lower 84*b* knife belt exits. For horizontal movement, the heated element carriage 194 provides for horizontal movement of the heated cutting element 180 in relation to shoulder pull belts 58*a*, 58*b* and an upper 84*a* and lower 84*b* knife belt exits.

It is recognized that the thermal cutting of a tubular cross section of tube 91 wrapped around the single stack product units 77 or double stack product units 79 could be achieved with numerous different designs whereby the horizontal motion of enclosed articles and a heated cutting member is synchronized during a cutting cycle in order to produce a substantially perpendicular cut, without sealing the tube 91, to direction of film travel. For example a heated cutting element 26 may be attached to rotating mechanism or other articulated means to achieve film separation.

As discussed in greater detail below, one preferred embodiment of the invention utilizes a cutting path wherein separation of tube 91 by heated cutting element 26 takes place during one half of the cycle in a downward transverse direction and the heated cutting element 26 is then returned to its starting position along the formed cut line. In an alternative embodiment, during the return motion to starting position a second cut is made.

Figures 6A, 6B:
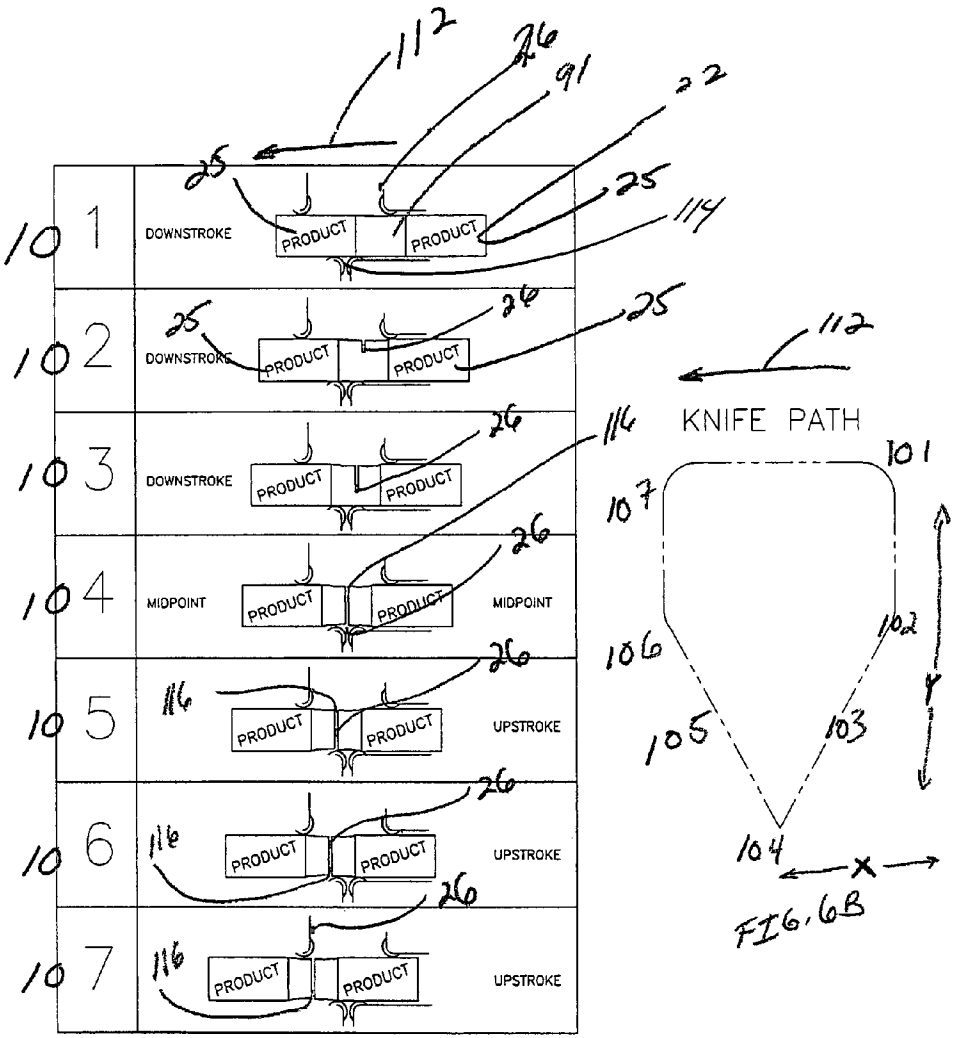
FIGS. 6A and 6B are schematics of a first cutting path of the cutting assembly of the system of FIG. 1.

FIGS. 6A-7B are schematic illustrations of preferred cutting cycles for the heated cutting element 26 including motion in two coordinates, namely the horizontal and transverse or vertical direction. FIGS. 6A and 6B illustrates a first cutting cycle wherein a single cut is made during a complete cycle. The illustrations in 6A illustrate the position of the heated cutting element 26 in relation to the tube 91 wrapped around a unit 25 of product 22. The schematic illustrated in 6B shows the path of the heated cutting element 26, generally corresponding to the positions illustrated in FIG. 6A. The direction of travel of the units 25 and tube 91 is illustrated by the arrow 112. As illustrated in FIG. 6A, the heated cutting element 26, begins its motion cycle at a position generally forward (in a direction opposite the motion of travel of the product 22 and tube 91) of the gap 114 between the forming shoulder product pull belts 58*a*, 58*b* and the knife exit belts 84*a*, 84*b*. The heated cutting element 26 begins its cutting motion with an initial downward transverse movement illustrated between positions 101 and 102. As the heated cutting element 26 engages the tube 91 inbetween sequential units 25, it continues its downward transverse movement, however, it moves horizontally as well as transversely. This two coordinate movement is illustrated in FIG. 6B between positions 102 and 103. The horizontal component of the motion is in the direction of the path of travel of the units 25 and tube 91 illustrated by arrow 112 and is preferably at a velocity equal to that motion. The transverse motion preferably occurs at a velocity greater than the horizontal motion. The two dimensional motion of the heated cutting element 26 continues between positions 103 and 104 as the heated cutting element 26 continues to move transversely and horizontally at a velocity equal to the velocity of the horizontal motion of the units 25 and tube 91. At position 104 the heated cutting element 26 has made a single cut 116 thereby separating two adjacent units 25 wrapped in the tube. The heated cutting element 26 pauses briefly at position 104 (near the gap 114 between the forming shoulder product pull belts 58*a*, 58*b* and the knife exit belts 84*a*, 84*b*).

Following the brief pause, the heated cutting element 26 continues its cutting cycle with upward transverse and horizontal motion asymmetrical to that occurring between positions 101 through 104. The movement of the heated cutting element 26 from positions 104 to 106 includes an upward or transverse component as well as a horizontal component. The horizontal component is in the same direction and at a velocity equal to the velocity of the horizontal motion of the product 22 and tube 91. As the heated cutting element 26 moves between positions 105 and 106 it is following the path of the previously formed cut 112. Between position 106 and 107, the heated cutting element 26 is no longer in the continuously moving tubular plastic 91 and it proceeds in solely transverse motion upward. Once the heated cutting element 26 completes its upward motion at position 107 it proceeds horizontally in a direction opposite the motion of travel of the product 22 and tube 91 back to position 101. The cycle is then repeated to form additional cuts.

Figures 7A, 7B:
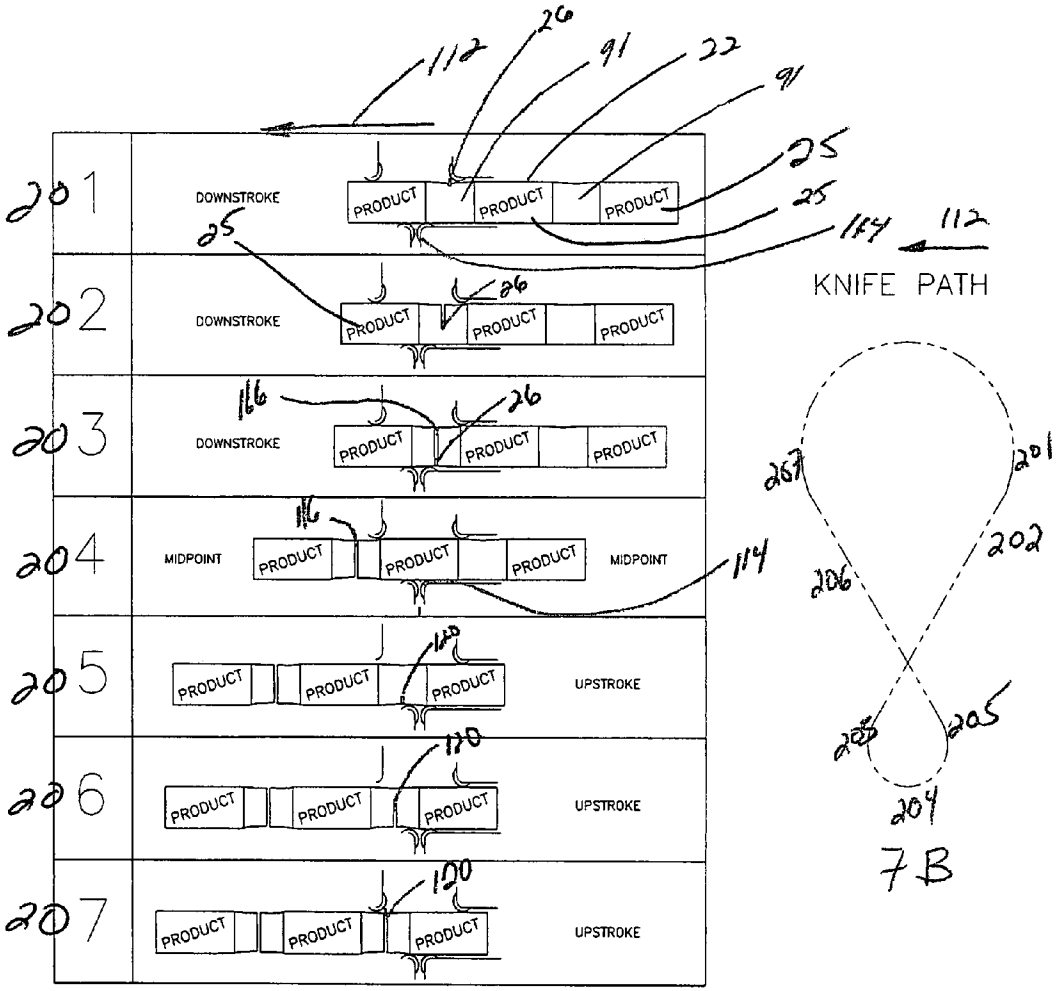
FIGS. 7A and 7B are schematics of an alternative cutting path of the cutting assembly of the system of FIG. 1.

FIGS. 7A and 7B illustrate an alternative heated cutting element 26 cycle wherein two cuts are made during a complete cutting cycle. The illustrations on the left show the position of the heated cutting element 26 in relation to the units 25 wrapped in the continuously moving tube 91. The schematic illustrated in 7B, shows the path of the heated cutting element 26, generally corresponding to the positions illustrated in FIG. 7A. The direction of travel of the units 25 and tube 91 is illustrated by the arrow 112. As illustrated in FIG. 7A, the heated cutting element 26, begins its motion cycle at a position generally forward (in a direction opposite the motion of travel of the product 22 and tube 91) of the gap 114 between the forming shoulder product pull belts 58*a*, 58*b* and the knife exit belts 84*a*, 84*b*. The heated cutting element 26 begins its cutting cycle with an initial downward movement illustrated near position 201. As the heated cutting element 26 engages the tube 91 inbetween sequential units 25, it continues its downward vertical motion and moves horizontally as well. This is illustrated in the movement between positions 201 and 202 in FIG. 7B. The additional horizontal motion is in the direction of the path of travel of the units 25 and tube 91 and is preferably at a velocity equal to that motion. The two dimensional motion of the heated cutting element 26 continues between positions 202 and 203 as the heated element continues to move transversely and horizontally at a velocity equal to the velocity of the horizontal motion of the units 25 and tube 91. As the heated cutting element 26 moves beyond position 203 the heated cutting element 26 has made a single cut 116 separating two adjacent products. The heated cutting element 26 then moves in a direction opposite the movement of the horizontal motion of the units 25 and tube 91 between positions 204 and 205.

At position 205, the heated cutting element 26 continues its cycle with an upward transverse motion. As illustrated, between positions 205 and 206, the motion of the heated cutting element 26 includes a vertical or transverse component as well as a horizontal component. The horizontal component is again at a velocity equal to the velocity of the horizontal motion of the units 25 and tube 91 and in the same direction. As the heated cutting element 26 moves between positions 205 and 206 a new second cut 120 is formed. At position 207 the heated cutting element 26 has completed the second cut 120 and is no longer in the continuously moving tubular plastic 91. The heated cutting element 26 then proceeds vertically and horizontally in a direction opposite the motion of travel of the product 22 and tube 91 back to position 201.

In operation, the web 50 is continuously drawn from the supply roll 24 and fed forward at the requisite speed. As it travels forward, the web travels around rolls, up to the forming shoulder 60 of the tube wrapper forming section 40, around the shoulder 60 and into and through a guide of the former. One or multiple spaced products 22 are continuously fed forward in units 25, one after another, by the infeed assembly 40 coming into position on the web 50 as it travels forward. The web is formed into the tube 91 around the units 25 of product, the tube with the units 25 therein being drawn forward at a predetermined tube feed speed by the forming shoulder product pull belts 58*a*, 58*b*. As the leading (downstream) end of the tube 91 enters the cutting assembly 70, the moveable heated cutting element 26 engages the tube to sever it between a leading edge and the remainder of the tube as the knife exit belts 84*a*, 84*b* pull the leading cut tube 91 with the units 25 therein forward. The heated cutting element 26 either returns along the cut line 116 or forms a second cut 120 in the tube 91 to sever the tube with the unit 25 therein away from the tube. If the second cut 120 is not formed in the single cycle illustrated in FIGS. 7A and 7B the second cut 120 is formed and the product separated by a repeat of the first cycle. Using either cycle, the unit 25 is separated from the tube, each comprising a wrapper with a single product or multiple products therein with the ends of the wrapper extending beyond the ends of the unit 25. As is known in the art, these projecting wrapper ends are subsequently folded in on the ends of the unit 25 and sealed to complete the package as is known in the art. This occurs on the assembly 20 downstream of the knife exit belts 84*a*, 84*b* at the left rear tucker assembly 302, right rear tucker assembly 304, flight table 306 and sealer discharge belts 308. These downstream components are well known in the art and need not be disclosed in detail.

It will be observed that the wrappers surrounding the products are, in effect, measured as a result of the timed relation between the speed of feed of the web 50, the speed of the single registration belts 32 and the twin pack registration belts 33 and the speed of the heated cutting element 26 moving through the tube. It should also be understood that the in feed compression belts 30, the single registration belts 32 and the twin pack registration belts 33, the forming shoulder infeed belts 44*a*, 44*b*, the forming shoulder product pull belts 58*a*, 58*b*, the knife exit belts 84*a*, 84*b* and the movement of the heated cutting element 26 are all servomotor driven. Each servomotor can be readily adjusted to allow for alternative spacing of the units 25 within the tube 91.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a wrapping system that includes a programmable infeed system and a cutting system that uses a moveable cutting element.

Furthermore, all the disclosed features of each disclosed embodiment can be combined with, or substituted for, the disclosed features of every other disclosed embodiment except where such features are mutually exclusive. For example, the inventive infeed system 40 could be used with other cutting mechanisms including prior art cutting mechanisms.

It is intended that the appended claims cover all such additions, modifications and rearrangements. Expedient embodiments of the present invention are differentiated by the appended claims.

The invention claimed is:

1. A method of spacing a supply of product into units to be wrapped in a continuous wrapping system comprising:

diverting continuous line of product onto a first set of moving belts;

driving a second set of moving belts to move temporarily at a velocity greater than the velocity of said first set of belts and a third set of moving belts that deliver the product units to a wrapping mechanism, and then driving the second set of moving belts at the velocity of the third set of belts so as to separate the products into spaced product units and to deliver the spaced product units to the third set of moving belts, wherein the second set of belts comprises vertically spaced upper and lower compression belts that compress the products into a desired girth for wrapping, and wherein only a single product unit is conveyed by the second set of belts at any given time.

2. An infeed assembly for a continuous wrapping system for compressible products, comprising:

a first, infeed belt assembly in communication with a supply of product;

a second, registration belt assembly that is located downstream of said infeed belt assembly and that comprises vertically spaced upper and lower infeed compression belts that compress the products into a desired girth for wrapping, and a third belt assembly that is located downstream of the registration belt assembly;

wherein the registration belt assembly is dimensioned and driven to convey only a single product unit at a time to the third belt assembly and to move the single product unit temporarily at a velocity greater than driven velocities of said infeed belt assembly and the third belt assembly before decelerating to the driven velocity of the third belt assembly in order to register and space one or more products into product units to be wrapped and to feed the registered spaced product units to the third belt assembly.

3. The infeed assembly of claim 2, wherein each of the upper and lower compression belts comprises single registration belt that separates a single product into a product unit to be wrapped.

4. The infeed assembly of claim 2, wherein the registration belt assembly comprises at least two horizontally spaced registration belt subassemblies that, in combination, separate multiple products into a product unit to be wrapped.

5. The infeed assembly of claim 2, wherein the distance between the upper and lower infeed compression belts is adjustable.

6. The infeed assembly of claim 2, wherein the registration belt assembly is driven to move at a velocity equal to the velocity of the infeed belt assembly to receive a single product unit, then to move at a velocity greater than the velocities of said infeed belt assembly and said third belt assembly once said product unit is on the registration belt assembly, and then to move at a velocity equal to the velocity of third belt assembly until the product unit is delivered to said third belt assembly, and then to return to a velocity equal to the velocity of the infeed belt assembly.

7. The infeed assembly of claim 2, wherein the product unit is at least one stack of napkins.

8. The infeed assembly of claim 2, wherein the product unit is at least one roll of paper.

9. The infeed assembly of claim 1, wherein the registration belt assembly is dimensioned and driven such that, during each 360° cycle of operation of the registration belt assembly, a single product unit is received from a plurality of products on the first infeed belt assembly, conveyed to the third belt assembly, and delivered to the third belt assembly with a designated spacing between successive product units.

10. A continuous wrapping system comprising:

an infeed assembly comprising a first, infeed belt assembly in communication with a supply of product;

a second, registration belt assembly that is located downstream of said infeed belt assembly and that comprises vertically spaced upper and lower infeed compression belts that compresses the products into a desired girth for wrapping; and a third belt assembly that is located downstream of the registration belt assembly: wherein the registration belt assembly is dimensioned and driven to convey only a single product unit at a time to the third belt assembly and to move the single product unit temporarily at a velocity greater than driven velocities of the infeed belt assembly and the third belt assembly before decelerating to the velocity of the third belt assembly in order to register and space one or more products into units to be wrapped and to feed to the registered spaced product units to the third belt assembly; and a tube wrapper forming section located downstream of said infeed assembly and configured to form a continuously moving tube of thermoplastic material from a web of said material around the product units to be wrapped; and a cutting system configured to separate the units from the continuously moving tube of thermoplastic material into individually wrapped units.

11. The continuous wrapping system of claim 10, wherein the registration belt assembly is driven to move at a velocity of a driven velocity of the infeed belt assembly to receive a single product unit, then to move at a velocity greater than the velocities of said infeed belt assembly and said third belt assembly once said product is on the registration belt assembly, and then to move at a velocity equal to the velocity of the third belt assembly until the product unit is delivered to said third belt assembly, and then to return to a velocity equal to the velocity of the infeed belt assembly.

12. The continuous wrapping system of claim 10, wherein the cutting system comprises a heated cutting element configured to separate the tubular thermoplastic material.

13. The continuous wrapping system of claim 12, wherein the heated cutting element moves in both the transverse and horizontal directions in relation to the movement of the tubular thermoplastic wrapping material.

14. The continuous wrapping system of claim 12, wherein at least a portion of the horizontal movement of the heated cutting element occurs at the same speed and in the same direction as the movement of the tubular thermoplastic wrapping material.

15. The continuous wrapping system of claim 10, wherein the registration belt assembly is dimensioned and driven such that, during each 360° cycle of operation of the registration belt assembly, a single product unit is received from a plurality of products on the first belt assembly, conveyed to the third belt assembly, and delivered to the third belt assembly with a designated spacing between successive product units.

* * * * *